United States Patent [19]

Graham et al.

[11] 4,323,361

[45] Apr. 6, 1982

[54] DYEING METHOD

[76] Inventors: John F. Graham, 2 Cherry Grove, Ilkley, West Yorkshire; Richard R. D. Holt, 14 Endor Grove, Burley-in-Wharfedale, West Yorkshire, both of England

[21] Appl. No.: 129,681

[22] Filed: Mar. 12, 1980

[30] Foreign Application Priority Data

Mar. 21, 1979 [GB] United Kingdom ..... 9984/79

[51] Int. Cl.[3] ..... D06P 5/20; G21K 5/08

[52] U.S. Cl. ..... 8/444

[58] Field of Search ..... 8/444

[56] References Cited

U.S. PATENT DOCUMENTS

| | | | |
|---|---|---|---|
| 2,366,347 | 1/1945 | Millson | 8/444 |
| 3,484,179 | 12/1969 | Adams et al. | 8/444 |
| 4,104,019 | 8/1978 | Smith | 8/444 |

FOREIGN PATENT DOCUMENTS

| | | | |
|---|---|---|---|
| 1003651 | 9/1965 | United Kingdom . | |
| 1275739 | 5/1972 | United Kingdom . | |
| 1450951 | 9/1976 | United Kingdom | 8/444 |

OTHER PUBLICATIONS

Dawson, T. L., Textile Month, Feb. 1972, pp. 47–48.

*Primary Examiner*—Maria Parrish Tungol

*Attorney, Agent, or Firm*—Norbert P. Holler; James J. Long

[57] ABSTRACT

In dyeing keratinous fibres, such as wool, by impregnating the fibres with aqueous compositions containing dyes, followed by storage in the moist condition, a higher level of fixation, enabling heavier shades to be obtained with cheaper dyes, can be achieved by raising the temperature of the stored fibres by means of radio frequency heating. The storage temperature is preferably between 40° and 80° C., which usually requires about 0.05 kw hour/kg fibres. Acid, milling, chrome and premetallized dyes can be used, as well as reactive dyes and substantive optical brighteners. The fibres are cuttled into an insulated plastics material cart located between a pair of electrodes in an r.f. chamber. One electrode is fixed and the other is adjustable so that the r.f. load acting on the fibres may be set at a desired value.

5 Claims, 2 Drawing Figures

DYEING METHOD

Figure 1:
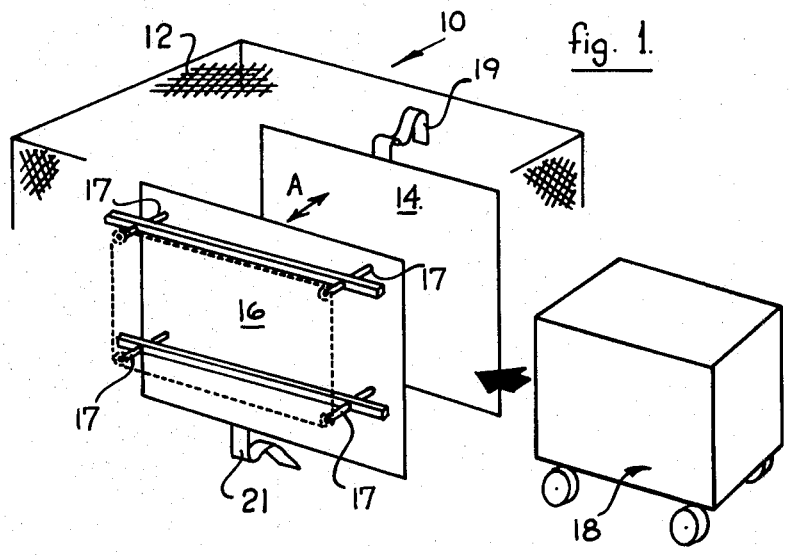

This invention relates to a method of fixing dyestuffs in textile fibres.

In our U.K. Pat. Nos. 1,003,651 and 1,275,739 there are disclosed methods of dyeing keratinous fibres by padding with dye liquors containing reactive dyestuffs and an acid amide such as urea, and storing the dyed fibres at ambient temperatures for a period sufficient to allow fixation of the dyestuff. This has considerable advantages in terms of energy and water savings and in decreased fibre damage over conventional dyeing at 100° C. or more, but suffers from the drawbacks that reactive dyes, which are in general relatively costly, must be used, and that heavy shades are difficult to obtain.

The invention seeks to provide a pad-store process in which less expensive dyestuffs can be used and heavy shades obtained without sacrificing the above advantages.

According to the present invention there is provided a method of dyeing keratinous fibres which comprises impregnating the fibres with an aqueous dyestuff composition and storing the fibres in the moist state for a period of 10 minutes to 72 hours, the storage temperature being raised preferably to between 40° and 80° C., by means of radio frequency energy.

The process can be applied to a wide variety of keratinous fibres, although the use of the wool of sheep is preferred. The wool can be in the form of slivers, loose fibres, slubbings, yarns and fabrics, whether in the form of piece goods or made-up garments. The wool may be natural or treated, e.g. shrink-proofed, or bleached.

The dyestuffs that may be used in the present process include reactive dyes, that is to say, those which react with the fibres and become attached to them by a covalent bond, but for reasons of cost it is preferred to use dyestuffs such as acid, acid milling, chrome and premetallised dyes, especially the latter. The terms also include whitening agents which combine with fibres.

The process according to the invention is applicable to all forms of pad-dyeing. Padding is the application of a liquor or paste to fibres by passing them through the liquor or paste and subsequently through squeeze rollers, or by passing between squeeze rollers one of which carries the liquor or paste. A pad mangle is a convenient apparatus for carrying out this operation. An alternative padding technique is to saturate the fibres with the dye liquor and then remove excess liquor under a vacuum. The preferred pick-up on the fibres is between 100–140%, preferably 120% owf.

After storage, excess dyestuff should be washed off the fibres, and the wash liquor may contain a base or reducing agent. Various reducing agents can be used, and for the purpose contained herein a reducing agent is a substance which is capable of breaking disulphide bonds in the keratin molecule. Suitable reducing agents include alkali metal, ammonium and amine sulphites and bisulphites, for example, sodium bisulphite, sodium meta bisulphite, and monoethanolamine bisulphite, certain quaternary phosphonium compounds, for example, tetrakis-(hydroxymethyl), - phosphonium chloride, sodium borohydride and thioglycollic acid. Various bases can be used which can comprise alkali metal or ammonium oxides and hydroxides, salts of strong bases and weak acids, for example, sodium bicarbonate, water-soluble aliphatic amines, for example dimethylamine. The reducing agents or bases are employed in the form of aqueous solutions which contain preferably 0.1 to 2.0% by weight of the dissolved material based on the weight of the solution. Ammonia is the preferred agent to use in the after-treatment step.

In dyeing by the method of the invention conventional additives such as surfactants, urea, thiourea, guanidine or their derivatives may be used.

Similarly, auxiliaries may be employed in the washing off procedure. Effective wash-off auxiliaries include a mixture of non-ionic surfactants used in combination with ammonia which removes unfixed dyestuff and residual dyeing auxiliaries, an example being Kieralon D (B.A.S.F.). Also a cationic complexing agent from a nitrogenous condensation product is effective in improving the fastness of monosulphonated premetallised and acid milling dyestuffs, an example being Sandopur SW, (Sandoz).

When producing shades on wool or similar materials by a method of impregnation followed by storage, it is accepted practice to add to the dye liquor a surfactant which produces rapid wetting of the wool at room temperature. These agents are exemplified by non-ionic condensation products of nonyl phenols with ethylene oxide to yield polyoxyethylated nonyl phenols containing from 10–30 moles of ethylene oxide, or by anionic alkyl sulphosuccinate derivatives. Also lauric diethanolamide type agents may be used. When hydrophilic dyes are used the addition of a surfactant is a preferred feature of the process if the best results are to be obtained.

The initial dyeing process can be carried out according to the manner known to the art. Thus the dye is first dissolved or dispersed in water, and preferably in the presence of an acid amide or thiamide, for example urea, and the dye composition can be padded on to the keratin fibres in the usual way, for example, by impregnation with a pad mangle. The process can be carried out at ambient temperatures, although slightly elevated temperatures e.g. from 15° or 30° to 40° C. are best. The dyeing can be carried out at a PH in the range of 2–10 but is preferably conducted at PH 2–7 and most preferably at PH3–6. The fibres are allowed to remain in contact with the dye for the minimum time for proper penetration, e.g. typically between 1 and 24 hrs, preferably about 12 hrs. The fibres may then be removed, squeezed to express excess liquid and then stored in the presence of moisture. The storage period is necessary for most dyeings and usually lasts from 10 mins. to 72 hrs; it ensures that the bulk of the dye is fixed to the keratinous fibres leading to a full shade development of the dye. After the storage period the fibres may be treated with a solution of the reducing agent or the base for a period of preferably 5 to 15 mins. Conventional equipment can be used for applying these solutions, for example, a beam washer, a winch or a conventional backwashing washing range.

When this treatment has been effected, the dyed fibres are then dried and when subjected to conventional wash fastness tests, and perspiration tests, the fastness results obtained are comparable with those obtained by conventional dyeing.

The storage, or batching, step may conveniently be carried out in a receptacle such as a cart, although any suitable container will suffice. Ideally the container is insulated to conserve heat. The textile fibres, e.g. sliver, is preferably cuttled into the cart and covered with an impermeable layer, such as a polyethylene sheet, to prevent loss of moisture. The electrodes of a radio frequency generator are placed in contact with the cart, on either side of it and power is applied to raise the temperature of the fibre ideally to within the range 40° C. to 80° C., preferably about 60° C. The power is then discontinued and the fibre stored for the period already discussed, during which time it loses some heat, but we have found that with a well-insulated container the temperature drop during storage is only in the order of a few degrees. To take an example, a 25 KW radio frequency Generator operated at a power output of 15 KW requires about 20 minutes to heat 100 kg of impregnated wool slivers to 60° C., i.e. about 5 kw-hours or 0.05 kw-hour/kg wool. Thus the amount of electricity used is small and so the low energy advantages of the cold pad-batch process are not lost, and at the temperatures employed fibre damage is mush less than with conventional dyeing.

We have found that radio frequency heating is uniquely suited to the process of the invention since no other method is capable of heating the batched fibres uniformly and economically to the desired temperature. Non-uniform heating will of course result in non-uniform fixation and unlevel dyeings which are commercially undesirable.

Further, the elevated storage temperature allows heavy shades to be developed and permits the use of dyestuffs other than reactive dyestuffs, especially mono and disulphonated 2:1 premetallised dyestuffs. An unexpected advantage is that the process of the invention will operate satisfactorily in many instances with very much less urea than has hitherto proved desirable in cold pad-batch dyeings, for example between 50–300 g/kg, preferably about 100 g/kg.

The invention also provides an apparatus for dyeing keratinous fibres which comprises an insulated container constructed from non-lossy materials for containing the fibres, a radio frequency chamber containing a fixed electrode and an adjustable electrode capable of receiving the cart therebetween, and a radio frequency generator connectable to said electrodes.

Figure 2:
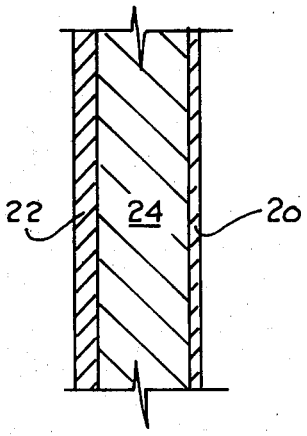

The invention will be described further with reference to the accompanying drawings, in which:

FIG. 1 is a general partial perspective view of a chamber and cart suitable for carrying out the invention; and FIG. 2 is a cross-sectional view of a wall of the cart.

The drawings illustrate a suitable radio frequency chamber 10 for carrying out the invention. The chamber 10 consists of a cage of metal screening 12, to contain stray r.f., within which are mounted a fixed electrode 14 and an adjustable electrode 16, movable in the direction of arrow A by means of screw drives 17. The electrode 14 is connected to an r.f. generator by a lead 19 and the electrode 16 is connected to earth by a lead 21.

The dye impregnated fibres are cuttled into a container 18, referred to as a "cart", which is dimensioned to fit in the chamber 10 between the electrodes 14 and 16, which latter are substantially co-extensive with the side walls of the cart 18.

As can be seen from FIG. 2, the cart 18 is double-skinned having an inner wall 20 and an outer wall 22 both of plastics material such as polypropylene or polyethylene, especially the latter. Between the walls 20, 22 is insulating material 24, in this case expanded polystyrene. It is necessary to choose the wall and insulating materials carefully to avoid absorption of r.f. energy by them causing them to heat up and be damaged, i.e. to use non-lossy materials.

The loaded cart is fitted with a top closure (not shown) and placed in the chamber 10 against the fixed electrode 14, and aligned therewith. The chamber 10 is closed, to prevent stray r.f. fields escaping and possibly injuring operatives, and the radio frequency is activated. The correct r.f. loading is obtained by actuating the screw drives 17 moving the electrode 16 towards or away from the cart 18 until the correct load is indicated on an r.f. output meter. The generator is used for sufficient time to bring the contents of the cart up to temperature (usually 60° C.) and then switched off. The temperature within the insulated cart then falls slowly to ambient over several hours completing fixation of the dyestuff.

The invention will be illustrated further by the following Examples.

In the examples the following procedure was adopted: Wool tops (sliver) of 64's quality and oil content of less than 1% were padded with the liquors indicated. After padding the sliver is cuttled into a cart insulated with polystyrene and constructed to the exact dimensions of the cuttled sliver so that air spaces are minimised, and the cart placed in an r.f. chamber as described above. A 20 KW Radio Frequency Generator operating at 27.12 M. Hertz was employed to raise the temperature of the cuttled batch after which it is stored for the time indicated before being washed off and dried using three wash liquors: cold, 60° C., and cold. An alternative r.f. generator also found to give good results was a 25 kw generator operating at 13.56 M. Hertz.

EXAMPLE 1

The following pad liquor was used:

| | |
|---|---|
| 20 g/kg | Neutrichrome Navy S-B11 Double |
| 100 g/kg | Urea |
| 8 g/kg | Solvitose OFA |
| 16 g/kf | Isopropyl alcohol |
| 20 g/kf | Detergyl EDC |
| 1 g/kg | Acetic acid |
| 3 g/kg | Etingal S |

100 kgs of 64's A wool top was padded to 118% pick-up, and radio frequency was applied at 5.4 Amps for 15 minutes to raise the temperature to 60° C., and the fibres were stored overnight. Backwashing was carried out in a 4 bowl Fleissner backwasher, using the following sequence:

| | |
|---|---|
| 1st bowl | Cold, 1 g/l Sandopur SW |
| 2nd bowl | 60° C., 1 g/l Sandopur SW |
| 3rd bowl | 50° C., plain water |
| 4th bowl | 35° C., 2 g/l Formic acid |

The following fastness results were obtained:

| | Change of Shade | Wool Staining | Cotton Staining |
|---|---|---|---|
| Water Fastness | 4 | 4 | 4 |
| Alkaline Perspiration | 3–4 | 4 | 4 |
| ISO 2 Wash Test | 4 | 4 | 3–4 |
| ISO 3 Wash Test | 3–4 | 2–3 | 3–4 |

From this it can be seen that dyeing compares well with conventional dyeings, but uses considerably less energy to achieve these results.

EXAMPLE 2

The following pad liquor was used:

| | |
|---|---|
| 3.17 g/kg | Verofix Yellow 3GL |
| 5.74 g/kg | Verofix Red BBL |
| 16.46 g/kg | Verofix Blue GGL |
| 100 g/kg | Urea |
| 8 g/kg | Solvitose OFA |
| 16 g/kg | Isopropyl alcohol |
| 10 g/kg | Levalin VKU |
| 2 g/kg | Acetic acid |
| 3 g/kg | Etingal S |

90 kgs of 64's wool top was padded to 120% pick-up. A radio frequency load of 4 Amps for 25 minutes raised the temperature 60° C. The load was stored overnight and washed-off using the following system:

| | |
|---|---|
| 1st bowl | Cold, ammonia PH 8.0 |
| 2nd bowl | 60° C., ammonia PH 8.0 |
| 3rd bowl | 50° C., plain water |
| 4th bowl | 35° C., PH 5.0 with acetic acid |

The following fastness results were obtained:

| | Change of Shade | Wool Staining | Cotton Staining |
|---|---|---|---|
| Water Fastness | 4–5 | 4 | 3–4 |
| Alkaline Perspiration | 4 | 4 | 3 |
| ISO 2 Wash Test | 4 | 4 | 3–4 |
| ISO 3 Wash Test | 4 | 4–5 | 2–3 |

Again a good dyeing was obtained with a low energy usage.

What is claimed is:

1. A method of dyeing keratinous fibers which comprises padding the fibers with an aqueous composition containing at least one dyestuff, transferring the padded fibers in a moist state to a thermally insulated batch storage zone in which the fibers are covered with an impermeable layer to prevent loss of moisture, subjecting the thus-stored fibers to radio frequency heating for only a period of time sufficient to raise the temperature of the fibers to between 40° and 80° C. and then discontinuing the heating, and thereafter continuing the batch storage of the moist heated fibers in the thermally insulated zone without further applied heat, to fix the dyestuff in the fibers.

2. A method as in claim 1 in which the fibers are wool fibers, the padding of the fibers with the dyestuff is carried out at a temperature of from 15° to 40° C., the temperature to which the fibers are heated by the radio frequency heating is about 60° C., and the amount of energy used to heat the fibers is of the order of 0.05 kw hour/kg of fibers.

3. A method according to claim 1 wherein the temperature is about 60° C.

4. A method according to claim 1, wherein the amount of energy used to heat the fibres is of the order of 0.05 kw hour/kg fibres.

5. A method according to claim 1 wherein the dyestuff comprises one or more reactive, acid, acid milling, chrome or premetallised dye or a substantive optical brightener or whitening agent, and the aqueous composition has a PH value of 2 to 7.

* * * * *